United States Patent [19]

Faecke

[11] Patent Number: 4,766,958

[45] Date of Patent: Aug. 30, 1988

[54] METHOD OF RECOVERING VISCOUS OIL FROM RESERVOIRS WITH MULTIPLE HORIZONTAL ZONES

[75] Inventor: David C. Faecke, Arlington, Tex.

[73] Assignee: Mobil Oil Corporation, New York, N.Y.

[21] Appl. No.: 2,589

[22] Filed: Jan. 12, 1987

[51] Int. Cl.[4] ..... E21B 43/24

[52] U.S. Cl. ..... 166/269; 166/272

[58] Field of Search ..... 166/269, 272

[56] References Cited

U.S. PATENT DOCUMENTS

| | | | |
|---|---|---|---|
| 2,973,039 | 2/1961 | Payne, Jr. | 166/269 X |
| 3,692,111 | 9/1972 | Breithaupt et al. | 166/269 X |
| 4,387,770 | 6/1983 | Hill | 166/269 X |
| 4,392,530 | 7/1983 | Odeh et al. | 166/269 |
| 4,519,454 | 5/1985 | McMillen | 166/303 |
| 4,593,759 | 6/1986 | Penick | 166/261 |
| 4,597,443 | 7/1986 | Shu et al. | 166/272 |
| 4,669,542 | 6/1987 | Venkatesan | 166/269 X |

*Primary Examiner*—Stephen J. Novosad

*Attorney, Agent, or Firm*—Alexander J. McKillop; Michael G. Gilman; Stanislaus Aksman

[57] ABSTRACT

There is disclosed a method of recovering viscous oil from a subterranean viscous oil-containing formation separated into at least one upper and at least one lower zone by a horizontal layer having lower vertical permeability than the rest of the reservoir. The method comprises injecting steam into the lower zone until steam breakthrough occurs at the production well; subsequently injecting steam into both the upper and the lower zones; and, continuing to inject steam into both zones and recovering fluids, including oil from the production well.

9 Claims, 1 Drawing Sheet

METHOD OF RECOVERING VISCOUS OIL FROM RESERVOIRS WITH MULTIPLE HORIZONTAL ZONES

BACKGROUND OF THE INVENTION

I. Field of the Invention

The invention is directed to an improved method of recovering viscous oil from a subterranean oil formation separated into at least two horizontal zones by an intervening horizontal layer having lower vertical permeability than the oil formation.

II. Description of the Prior Art

Many oil reservoirs, such as heavy oil or tar sand formations, exist which contain vast quantities of oil which cannot be recovered by conventional techniques because the oil is so viscous that it is substantially immobile at reservoir conditions. Therefore, some form of supplemental oil recovery must be used in such formations to decrease the viscosity of the oil sufficiently to allow it to flow through the formation to the production well and then be brought to the surface of the earth. Thermal recovery techniques which decrease the viscosity of such oil and are therefore suitable for stimulating the recovery thereof include steam flooding and in-situ combustion.

Steam has been utilized in the past for thermal stimulation of viscous oil in so-called steam drive or steam throughput processes in which steam is injected into the formation on a substantially continuous basis through an injection well, and oil, having reduced viscosity, is recovered from the formation from a spaced-apart production well. The mechanism of the oil production by steam flooding is believed to involve the condensation of the steam upon contact with the cooler formation sands and the migration of the resulting hot water through the viscous oil, thereby reducing the viscosity of the oil and allowing it to flow more easily. This oil is then produced from production wells spaced-apart from the injection wells. In prior art, steam flooding has been applied to viscous oil reservoirs separated into at least one lower and one upper zone by at least one intervening horizontal layer of a different material, e.g., shale, with much lower vertical permeability than the rest of the formation. It was thought that such a horizontal layer formed a complete barrier to the flow of steam. Accordingly, each of the zones of the formation was treated separately with steam by injecting the steam separately into each of the zones and producing oil from each zone independently. Such a manner of operating the steam flooding process often resulted in a substantially delayed steam breakthrough as compared to steam flooding operations in viscous oil reservoirs forming substantially one vertically extending reservoir without an intermediate horizontal layer. Therefore, the commencement of the increased oil production which accompanies steam breakthrough from such layered reservoirs was also delayed.

Accordingly, a need still exists in the art for providing an improved method of recovering viscous oil by steam flooding of a layered reservoir.

This and other objects of the invention will become apparent to those skilled in the art from the following description thereof.

SUMMARY OF THE INVENTION

The invention is directed to a method of recovering viscous oil from a subterranean formation separated into at least one upper zone and at least one lower zone by at least one horizontal layer having lower vertical permeability than the remainder of the reservoir. The formation is penetrated by at least one injection well, and at least one production well, which is completed in both the upper and lower zones and is spaced-apart from the injection well. The method comprises the steps of:

1. injecting steam only into the lower zone through the injection well until steam breakthrough occurs at the production well;
2. injecting steam into both the upper and the lower zones, after the steam breakthrough occurs; and
3. continuously injecting steam into both the upper and the lower zones and recovering fluids, including oil, from the production well.

DETAILED DESCRIPTION OF THE INVENTION

Figure 1:
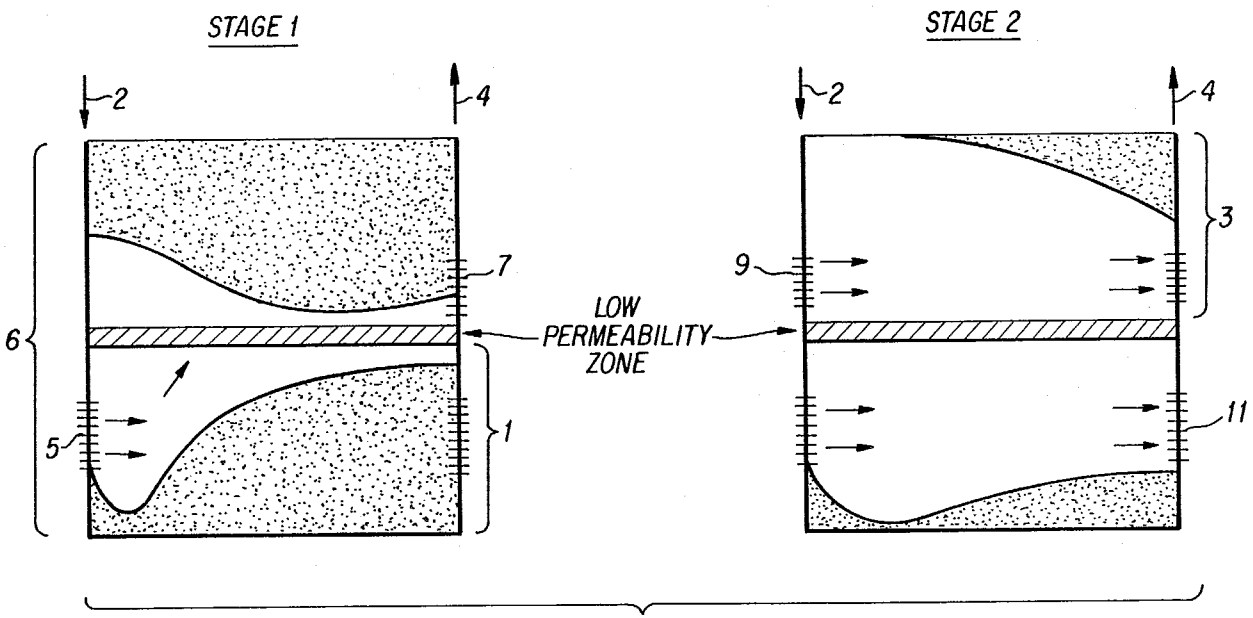
FIG. 1 is a schematic representation of one exemplary embodiment of the present invention.

The viscous oil which can be recovered in accordance with the present invention is defined as oil with an API gravity of about 25° or less and a viscosity greater than about 20 centipoise at reservoir conditions.

The viscous oil formation subjected to the method of the present invention is a formation which contains at least one intervening horizontal layer having lower vertical permeability than the remainder of the reservoir. Such a horizontal layer divides the reservoir into at least one upper zone and at least one lower zone, thereby producing at least two distinct reservoir zones containing the viscous oil. The horizontal layer is formed of a different type of material than the remainder of the reservoir rock. Thus, the horizontal layer may be a shale or diatomite barrier about 10–50 feet in thickness. The thickness and the composition of the horizontal layer are not crucial to the method of the present invention and they will be different for different reservoirs, as will be apparent to those skilled in the art. An important aspect of the present invention is that the horizontal layer must separate the reservoir into at least two substantially distinct, horizontal, vertically-spaced zones containing the viscous oil. The vertical permeability of the horizontal layer is at least 1, preferably at least 5, and most preferably at least 25 millidarcies (md). I found that the method of the invention proceeds relatively slowly if the permeability of the horizontal layer is 1–5 md, the speed thereof increases substantially if the permeability of the horizontal layer is at least 5 md and the method is conducted with especially high speed and efficiency with formations having the horizontal layer with the permeability of at least about 25 md.

The rate of steam injection into the upper zone and the lower zone is also important in the method of the present invention. The steam must be injected into the lower zone in the first step of the method at the rate of about 1.0 to about 2.0 barrels per day of cold water equivalent per acre-foot of the portion of the formation permeable to steam.

The volume, V, of a steam flood pattern is calculated from the following equation:

$$V = h \times A$$

wherein h is the gross reservoir thickness permeable to steam, in feet, as defined below; and A is the area of the pattern, in acres.

Since it is imperative for the method of the invention to maintain the proper steam flux, if steam availability is limited, the pattern area must be reduced to maintain the proper steam flux.

The term "portion or thickness of the formation permeable to steam" designates all of the formation having steam permeability, which includes the upper zone, the intervening low permeability layer, the lower zone, and the water-containing or water-saturated portion of the formation below the oil- water contact line. Thus, the total thickness of the formation is considered in calculating the amount of steam necessary to be injected into the upper and the lower zones of the formation. In this respect, the method of the present invention is distinct and different from the steam flooding methods of prior art since in the latter it was presumed that the intervening horizontal layer separating a formation into an upper and a lower zone was totally impermeable to steam and formed a substantially complete and effective block to the flow of steam. Thus, steam injection rates were calculated independently for each zone. Similarly, in prior art, the thickness of the portion of the formation below the oil-water line was disregarded since it contained no substantial volume of oil.

Without wishing to be bound by any theory of operability, it is believed that the intervening horizontal layer having lower vertical permeability than the remainder of the reservoir does not necessarily form an absolute barrier to the vertical movement of steam. Instead, it is believed, the layer having reduced vertical permeability acts as a baffle which restricts or regulates the vertical steam movement, thereby forcing the steam to spread laterally as it moves upwardly through the reservoir. Since the horizontal layer may effectively form an absolute barrier to the flow of steam when the vertical permeability thereof is less than 1 md, the method of the invention, as discussed above, is not applicable to the reservoirs containing a horizontal layer having such a low vertical permeability.

The first step of the method is conducted until steam breakthrough occurs at the production well, i.e., until steam is produced in the production well. The steam breakthrough, as is known to those skilled in the art, is normally accompanied by a relatively large increase in oil production.

Substantially immediately after steam breakthrough is observed at the production well, the second step of the method is commenced. In this step, steam is injected into the upper zone of the reservoir, while the injection of the steam into the lower zone of the reservoir is continued. Steam can be injected into the upper zone, for example, by opening the original injection well in the upper zone or by providing a separate injection well in the upper zone. The total rate of steam injected in this step into the reservoir is also about 1 to about 2 barrels per day of cold water equivalent per acre-foot of the portion of the formation permeable to steam. Subsequently, the injection of steam into the upper and the lower zones of the reservoir is conducted continuously, and the fluids, including oil, are recovered from the production well until the rate of oil production decreases to a level such that the economic limit of the oil production is reached.

The multi-step process of the invention provides an optimal combination of early increased oil production and high recovery efficiency, since, it is believed, the reduced-permeability layer acts not as a barrier to the vertical movement of steam, but instead as a baffle and causes the steam to spread laterally as it moves vertically through the reservoir along and underneath the reduced-permeability layer. At the same time, however, because of the gravity override effect, steam also penetrates and moves vertically through the reduced-permeability layer, as shown in the Stage 1 diagram of FIG. 1. Thus, steam breakthrough at the production well occurs first in the upper zone because, it is believed, of the steam override effect within the lower zone of the reservoir. This results in an earlier increased oil production rate and a more reasonable steam breakthrough time (SBT) as compared to previously-used steam-flooding operations, such as steam flooding the two separate zones independently of each other.

In the second step of the process, when the steam is injected concurrently into the upper and the lower zones of the reservoir, the vertical sweep efficiency within the zones is improved and oil recovery is maximized because, it is believed, the injection of the steam in the upper zone causes the lateral movement of the steam flood front, thereby increasing vertical sweep efficiency within the zones and maximizing oil recovery.

Steam used in both steps of the invention has the temperature of about 475° F. to about 700° F., preferably about 475° F. to about 550° F., and a quality of about 50 to about 90%, preferably about 50 to about 65% at the wellbore of the injection well.

The method of the invention can be used with any multi-zone reservoir containing one or more horizontal layers having lower vertical permeability than the remainder of the reservoir. Thus, the method can be used with the underground reservoirs containing several, e.g., three or four, horizontal layers separating the reservoir into four or five, respectively, separate zones. In this case, the method should be initiated in the lowest zone and proceed consecutively upwardly to each of the higher zones. However, in the preferred embodiment, it is conducted with a reservoir having one horizontal layer, of lower permeability than the remainder of the reservoir, separating the reservoir into one upper and one lower zone.

The preferred embodiment of the method of the invention is exemplified below and in FIG. 1. In stage 1 or step 1, the injection well 2 is opened only in the lower zone 1, while the production well is completed in both the upper and lower zones. Steam is first injected into the formation 6 into the lower reservoir zone 1, through the lower portion 5 of the injection well 2. Because of the movement of steam upward through the low permeability zone due to gravity, steam first breaks through into the producing well 4 from the portion 7, placed in the upper zone 3. After steam breakthrough occurs, the injection well is opened in the upper reservoir zone, in the upper portion 9 of the injection well 2. Steam injection is continued into the lower reservoir zone 1 and it is supplemented by the injection of steam into the upper zone 3 through the upper portion 9 of the injection well. Thus, in the second step or stage of the process, the steam injection is conducted into both, the upper and the lower zones. The fluids, including oil, are recovered from the reservoir through the producing well 4. In FIG. 1, steam zone is indicated by clear, white area, while the reservoir formation not yet penetrated by steam, by a shaded area.

It will be apparent to those skilled in the art that the specific embodiments discussed above can be successfully repeated with ingredients equivalent to those generically or specifically set forth above and under variable process conditions.

From the foregoing specification, one skilled in the art can readily ascertain the essential features of this invention and without departing from the spirit and scope thereof can adapt it to various diverse applications.

I claim:

1. A method of recovering viscous oil from a viscous oil-containing formation separated, by at least one horizontal layer having vertical permeability of at least about 1 md, into at least one upper zone and at least one lower zone, the formation being penetrated by at least one injection well and at least one spaced-apart production well, comprising the consecutive steps of:

(1) injecting through the injection well steam only into the lower zone until steam breakthrough occurs at the production well;

(2) thereafter injecting steam into both, the upper and the lower zones; and (3) continuously injecting steam into the upper and the lower zones and recovering fluids, including oil, from the production well.

2. A method of claim 1 wherein the horizontal layer has the vertical permeability of at least about 5 md.

3. A method of claim 2 wherein the horizontal layer has the vertical permeability of at least about 25 md.

4. A method of claim 3 wherein the steam is injected in said step (1) at the rate of about 1 to about 2 barrels per day, of cold water equivalent, per acre-foot of the portion of the formation permeable to steam.

5. A method of claim 4 wherein the steam is injected in said step (2) at the rate of about 1 to about 2 barrels per day, of cold water equivalent, per acre-foot of the portion of the formation permeable to steam.

6. A method of claim 5 wherein the steam has the temperature of about 475° F. to about 700° F. and a quality of about 50 to about 90%.

7. A method of claim 6 wherein the steam has the temperature of about 475° F. to about 550° F. and a quality of about 50 to 65%.

8. A method of claim 7 wherein the viscous oil has an API gravity of about 25° or less and a viscosity greater than about 20 centipoise at reservoir conditions.

9. A method of claim 8 wherein in said step (1) said steam breakthrough occurs only in the upper zone.

* * * * *